US007129897B2

(12) United States Patent
Iigusa et al.

(10) Patent No.: US 7,129,897 B2
(45) Date of Patent: Oct. 31, 2006

(54) ARRAY ANTENNA APPARATUS CAPABLE OF SWITCHING DIRECTION ATTAINING LOW GAIN

(75) Inventors: Kyoichi Iigusa, Kyoto (JP); Takuma Sawaya, Kyoto (JP); Takashi Ohira, Kyoto (JP); Hiroki Tanaka, Kyoto (JP); Makoto Taromaru, Kyoto (JP)

(73) Assignee: Advanced Telecommunications Research Institute International, Kyoto (JP)

( * ) Notice: Subject to any disclaimer, the term of this patent is extended or adjusted under 35 U.S.C. 154(b) by 0 days.

(21) Appl. No.: 11/056,003

(22) Filed: Feb. 14, 2005

(65) Prior Publication Data

US 2005/0179605 A1 Aug. 18, 2005

(30) Foreign Application Priority Data

Feb. 16, 2004 (JP) ..... 2004-038178

(51) Int. Cl.
*H01Q 1/38* (2006.01)

(52) U.S. Cl. ..... 343/700 MS; 343/745

(58) Field of Classification Search ..... 343/700 MS, 343/745

See application file for complete search history.

(56) References Cited

U.S. PATENT DOCUMENTS 3,454,950 A * 7/1969 Grant et al. ..... 343/751
4,812,855 A * 3/1989 Coe et al. ..... 343/818
5,497,164 A * 3/1996 Croq ..... 343/700 MS
5,539,419 A * 7/1996 Ogawa et al. ..... 343/761
5,754,146 A * 5/1998 Knowles et al. ..... 343/895
6,025,812 A * 2/2000 Gabriel et al. ..... 343/797
6,211,830 B1 * 4/2001 Monma et al. ..... 343/702
6,509,883 B1 * 1/2003 Foti et al. ..... 343/850
6,606,057 B1 * 8/2003 Chiang et al. ..... 342/374

OTHER PUBLICATIONS

Takashi Ohira et al.; "Basic Theory on 2-Element Espar Antennas from Reactance Diversity Viewpoint"; *Technical Report of The Institute of Electronics, Information and Communications Engineers*: c. 2002; pp. 13-18.

* cited by examiner

*Primary Examiner*—HoangAnh Le
*Assistant Examiner*—Tung Le
(74) *Attorney, Agent, or Firm*—McDermott Will & Emery LLP

(57) ABSTRACT

An array antenna apparatus includes a dielectric substrate, a feeder element, a parasitic element, and a directivity control unit. The feeder element and the parasitic element have an equal length. The feeder element and the parasitic element are arranged such that they intersect with each other at a substantially central portion of the parasitic element and a feeder unit of the feeder element and such that the parasitic elements are arranged symmetrically around the feeder element. An interval between the feeder element and the parasitic element is not larger than half wavelength of a radio wave. The parasitic element has a varactor diode serving as a variable capacitance element loaded. The directivity control unit supplies a control voltage to the varactor diode, and switches directivity of the array antenna apparatus.

6 Claims, 11 Drawing Sheets

ARRAY ANTENNA APPARATUS CAPABLE OF SWITCHING DIRECTION ATTAINING LOW GAIN

BACKGROUND OF THE INVENTION

1. Field of the Invention

The present invention relates to an array antenna apparatus allowing electrical switching of directivity.

2. Description of the Background Art

A conventional array antenna apparatus has a two-dimensional structure shown in FIG. 11, for example (see "Basic Theory on 2-element Espar Antennas from Reactance Diversity Viewpoint", Ohira, Iigusa and Taromaru, Technical Report of IEICE, AP2002-93, pp. 13–18). A conventional array antenna apparatus 100 includes a dielectric substrate 110, a feeder element 111 arranged on one main surface of dielectric substrate 110, and parasitic elements 112, 113.

Dielectric substrate 110 has a substantially rectangular two-dimensional shape, and feeder element 111 and parasitic elements 112, 113 are arranged in parallel to one side of the rectangle.

More specifically, parasitic elements 112 and 113 are arranged symmetrically around feeder element 111. Intervals d between feeder element 111 and parasitic element 112 and between feeder element 111 and parasitic element 113 are set to $\lambda/4$ or $\lambda/10$, when a radio wave transmitted/received by array antenna apparatus 100 has a wavelength of $\lambda$.

Parasitic elements 112, 113 have varactor diodes 114, 115 serving as variable capacitance elements loaded, respectively. By controlling a voltage supplied to varactor diodes 114, 115, array antenna apparatus 100 has its directivity switched, while maintaining impedance matching. More specifically, when voltages supplied to varactor diodes 114, 115 are denoted as V1 and V2 respectively that can be set to Va, Vb respectively, voltages V1 and V2 are switched between [V1=Va, V2=Vb] and [V1=Vb, V2=Va]. Then, reactance values −Xa, −Xb loaded to parasitic elements 112, 113 respectively are switched, so that array antenna apparatus 100 has its directivity switched, while maintaining impedance matching.

FIG. 12 illustrates a directivity gain pattern in a plane provided with an antenna, that is, in a $\phi$ plane, when interval d is set to $\lambda/4$, while FIG. 13 illustrates a directivity gain pattern in the $\phi$ plane when interval d is set to $\lambda/10$. When interval d is set to $\lambda/4$ and when a set of reactance values −Xa, −Xb is set to [−Xa=−455Ω, −Xb=−37Ω], array antenna apparatus 100 shows a directivity gain pattern PT1, and attains high gain in a direction where $\phi$=270°. Meanwhile, when a set of reactance values −Xa, −Xb is set to [−Xa=−37Ω, −Xb=−455Ω], array antenna apparatus 100 shows a directivity gain pattern PT2, and attains high gain in a direction where $\phi$=90°.

When interval d is set to $\lambda/10$ and when a set of reactance values −Xa, −Xb is set to [−Xa=−455Ω, −Xb=−37Ω], array antenna apparatus 100 shows a directivity gain pattern PT3, and attains high gain in a direction where $\phi$=270°. Meanwhile, when a set of reactance values −Xa, −Xb is set to [−Xa=−37Ω, −Xb=−455Ω], array antenna apparatus 100 shows a directivity gain pattern PT4, and attains high gain in a direction where $\phi$=90°.

Therefore, whether interval d is set to $\lambda/4$ or $\lambda/10$, setting of a set of reactance values −Xa, −Xb is switched between [−Xa=−455Ω, −Xb=−37Ω] and [−Xa=−37Ω, −Xb=−455Ω], so that array antenna apparatus has its directivity switched between a direction of 90° and a direction of 270°. The direction of 90° and the direction of 270° correspond to a direction DR1 in FIG. 11.

SUMMARY OF THE INVENTION

In the conventional array antenna apparatus, however, a direction of 0° and a direction of 180° represent a null direction attaining zero gain. The direction of 0° and the direction of 180° correspond to a direction DR2 in FIG. 11. Therefore, the conventional array antenna apparatus does not have directivity in a direction in which the feeder element and the parasitic element are arranged. In other words, in the conventional array antenna apparatus, even when the reactance values are switched while impedance matching is being maintained, there is a direction in which the array antenna apparatus does not have directivity. In addition, the conventional array antenna apparatus has sensitivity to a polarized wave non-orthogonal to the element, whereas it does not have sensitivity to a polarized wave orthogonal thereto, resulting in failure in switching a direction of the polarized wave.

Accordingly, the present invention was made to solve the above-described problems. An object of the present invention is to provide an array antenna apparatus allowing switching of directivity and a polarization direction, free from a direction attaining zero gain, that is, having directivity in all azimuths.

Another object of the present invention is to provide an array antenna apparatus having sensitivity to a polarized wave orthogonal to a feeder element, in which a polarization direction attaining excellent sensitivity is switched.

Yet another object of the present invention is to provide an array antenna apparatus switching a direction attaining low gain by switching directivity.

According to the present invention, an array antenna apparatus includes a feeder element, at least one parasitic element, and a directivity control unit. At least one parasitic element has a variable capacitance element loaded. The directivity control unit varies at least one capacitance of the variable capacitance element loaded to at least one parasitic element, so as to control directivity. An interval between each of at least one parasitic elements and the feeder element is set to be not larger than half wavelength of a radio wave that is transmitted and received. When at least one parasitic element and the feeder element are projected on one plane, at least one parasitic element is arranged such that a longitudinal direction of at least one parasitic element is at a prescribed angle with respect to a longitudinal direction of the feeder element.

Preferably, the feeder element and at least one parasitic element intersect with each other at one portion of each element.

Preferably, at least one parasitic element includes first to fourth parasitic elements arranged so as to substantially form a rectangle. The feeder element is arranged along a diagonal of the rectangle.

Preferably, at least one parasitic element includes two or more parasitic elements. One parasitic element has one end intersecting with one end of another parasitic element.

Preferably, the two or more parasitic elements are arranged symmetrically around the feeder element.

Preferably, the feeder element and at least one parasitic element are arranged two-dimensionally.

In the array antenna apparatus according to the present invention, the interval between each parasitic element and the feeder element is set to be not larger than half wavelength of a radio wave. In addition, the parasitic element is arranged at a prescribed angle with respect to the feeder element. In such an arrangement, at least one capacitance of the variable capacitance element loaded to at least one parasitic element is varied, so as to control directivity.

Therefore, according to the present invention, the array antenna apparatus can switch directivity and can have directivity in all azimuths. In addition, the array antenna apparatus has sensitivity to the polarized wave orthogonal to the feeder element, and can switch a polarization direction attaining good sensitivity.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
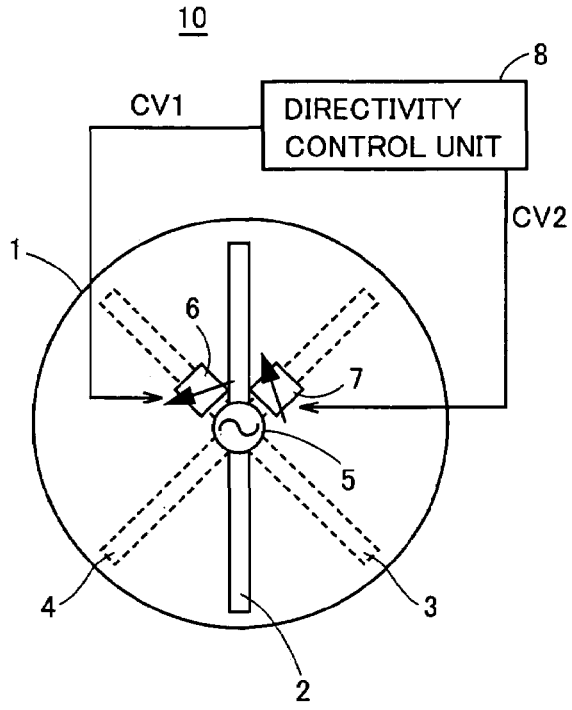
FIG. 1 is a first plan view of an array antenna apparatus in an embodiment of the present invention.

In the following, embodiments of the present invention will be described in detail with reference to the figures. It is noted that the same reference characters refer to the same or corresponding components in the figures.

FIG. 1 is a first plan view of an array antenna apparatus in an embodiment of the present invention. An array antenna apparatus 10 includes an annular dielectric substrate 1, a feeder element 2, parasitic elements 3, 4, and a directivity control unit 8.

All of feeder element 2 and parasitic elements 3, 4 have an equal length. Feeder element 2 and parasitic elements 3, 4 are arranged such that they intersect with one another at a substantially central portion of parasitic elements 3, 4 and a feeder unit 5 of feeder element 2 and such that parasitic elements 3, 4 are arranged symmetrically around feeder element 2. Here, feeder element 2 is formed on one main surface (a surface, for example) of dielectric substrate 1, while parasitic elements 3, 4 are formed on a side opposite to one main surface (surface) of dielectric substrate 1 (back surface). An interval between feeder element 2 and parasitic elements 3, 4 (an interval between a center of feeder element 2 and respective centers of parasitic elements 3, 4) is set to be not larger than half ($=\lambda/2$) of a wavelength $\lambda$ of a radio wave transmitted/received by array antenna apparatus 10. Since feeder element 2 and parasitic elements 3, 4 intersect with one another in array antenna apparatus 10, feeder element 2 and parasitic elements 3, 4 are formed on different surfaces of dielectric substrate 1 in order to avoid overlapping.

Parasitic elements 3, 4 have varactor diodes 6, 7 serving as variable capacitance elements loaded, respectively. Directivity control unit 8 supplies control voltages CV1, CV2 to varactor diodes 6, 7 respectively. Here, control voltages CV1, CV2 can be set to Va, Vb respectively. Therefore, directivity control unit 8 supplies [CV1=Va, CV2=Vb] or [CV1=Vb, CV2=Va] to varactor diodes 6, 7, so that a combination of reactance values −Xa, −Xb of parasitic elements 3, 4 are changed. That is, directivity control unit 8 varies reactance values −Xa, −Xb (capacitance) of parasitic elements 3, 4, so as to control directivity of array antenna apparatus 10. Here, as feeder element 2 and parasitic elements 3, 4 are not parallel to one another, a polarization direction of a radio wave emitted from array antenna apparatus 10 can be controlled by changing a combination of reactance values −Xa, −Xb and changing a parasitic element to be excited.

Figure 2:
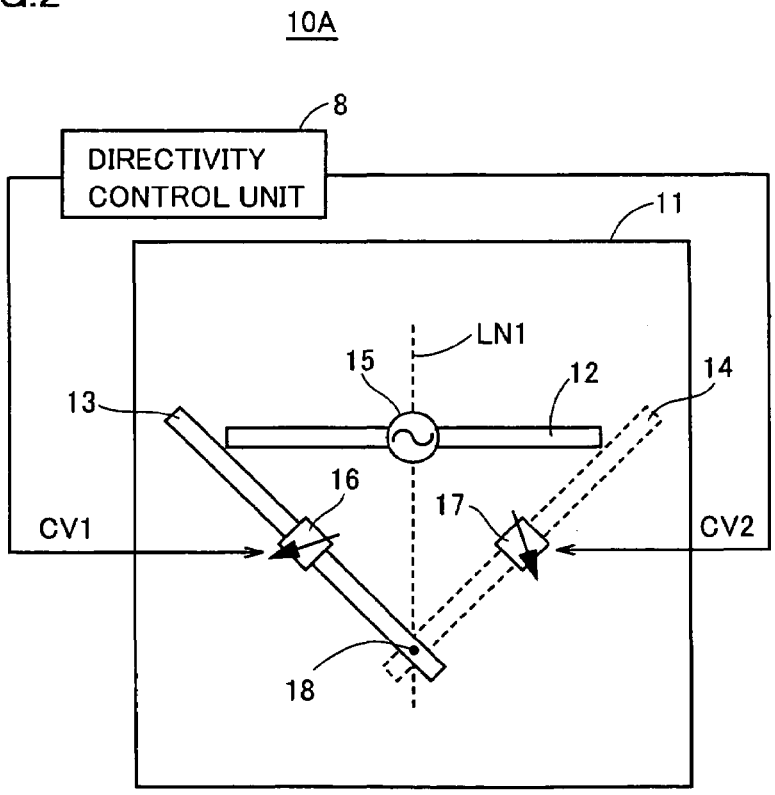
FIG. 2 is a second plan view of an array antenna apparatus in the embodiment of the present invention.

FIG. 2 is a second plan view of an array antenna apparatus in the embodiment of the present invention. An array antenna apparatus 10A includes a dielectric substrate 11, a feeder element 12, parasitic elements 13, 14, and directivity control unit 8.

Dielectric substrate 11 has a substantially rectangular two-dimensional shape. All of feeder element 12 and parasitic elements 13, 14 have an equal length. Feeder element 12 and parasitic elements 13, 14 are arranged so as to form an isosceles triangle of which two sides form a right angle. Here, feeder element 12 is arranged in a position corresponding to a base of the isosceles triangle, while two parasitic elements 13, 14 are arranged so as to form a right angle therebetween. Parasitic element 13 intersects with parasitic element 14, whereas feeder element 12 does not intersect with parasitic elements 13, 14. Therefore, feeder element 12 and parasitic element 13 are formed on one main surface (a surface, for example) of dielectric substrate 11, while parasitic element 14 is formed on a side opposite to one main surface (surface) of dielectric substrate 11 (back surface).

Parasitic elements 13, 14 are arranged symmetrically around a line LN1 extending from an intersection 18 of parasitic element 13 and parasitic element 14 to a feeder unit 15 of feeder element 12. In other words, parasitic elements 13, 14 are arranged symmetrically around feeder element 12. Here, an interval between feeder element 12 and parasitic elements 13, 14 is set to be not larger than $\lambda/2$.

Parasitic elements 13, 14 have varactor diodes 16, 17 serving as variable capacitance elements loaded, respectively. Directivity control unit 8 supplies control voltages CV1, CV2 to varactor diodes 16, 17 respectively, so as to change a combination of reactance values −Xa, −Xb (capacitance) of parasitic elements 13, 14 and to control directivity of array antenna apparatus 10A. Here, as feeder element 12 and parasitic elements 13, 14 are not parallel to one another, a polarization direction of a radio wave emitted from array antenna apparatus 10A can be controlled by changing a combination of reactance values −Xa, −Xb and changing a parasitic element to be excited.

Figure 3:
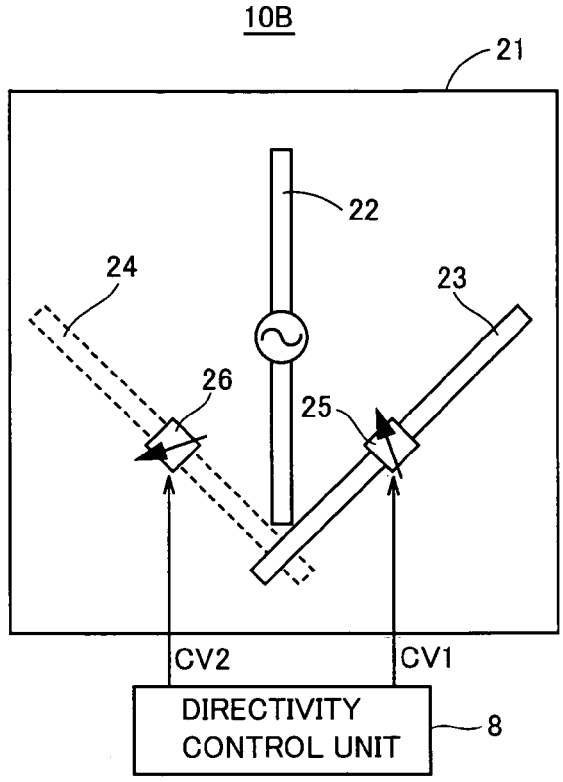
FIG. 3 is a third plan view of an array antenna apparatus in the embodiment of the present invention.

FIG. 3 is a third plan view of an array antenna apparatus in the embodiment of the present invention. An array antenna apparatus 10B includes a dielectric substrate 21, a feeder element 22, parasitic elements 23, 24, and directivity control unit 8.

Dielectric substrate 21 has a substantially rectangular two-dimensional shape. All of feeder element 22 and parasitic elements 23, 24 have an equal length. Feeder element 22 and parasitic elements 23, 24 are arranged in a shape of an arrow. Here, feeder element 22 is arranged in a position corresponding to an axis of the arrow shape, while two parasitic elements 23, 24 are arranged so as to form heads of the arrow. Parasitic element 23 intersects with parasitic element 24, whereas feeder element 22 does not intersect with parasitic elements 23, 24. Therefore, feeder element 22 and parasitic element 23 are formed on one main surface (a surface, for example) of dielectric substrate 21, while parasitic element 24 is formed on a side opposite to one main surface (surface) of dielectric substrate 21 (back surface).

Parasitic elements 23, 24 are arranged symmetrically around feeder element 22. Here, an interval between feeder element 22 and parasitic elements 23, 24 is set to be not larger than λ/2.

Parasitic elements 23, 24 have varactor diodes 25, 26 serving as variable capacitance elements loaded, respectively. Directivity control unit 8 supplies control voltages CV1, CV2 to varactor diodes 25, 26 respectively, so as to change a combination of reactance values −Xa, −Xb (capacitance) of parasitic elements 23, 24 and to control directivity of array antenna apparatus 10B. Here, as feeder element 22 and parasitic elements 23, 24 are not parallel to one another, a polarization direction of a radio wave emitted from array antenna apparatus 10B can be controlled by changing a combination of reactance values −Xa, −Xb and changing a parasitic element to be excited.

In FIGS. 2 and 3, the two parasitic elements may be provided without overlapping with each other. The two parasitic elements do not overlap with each other, for example, by decreasing a length of parasitic elements 13, 14 and 23, 24, by providing parasitic elements 13, 14 (23, 24) more distant from each other, or by adjusting an angle between feeder element 22 and parasitic elements 13, 14 (23, 24).

Figure 4:
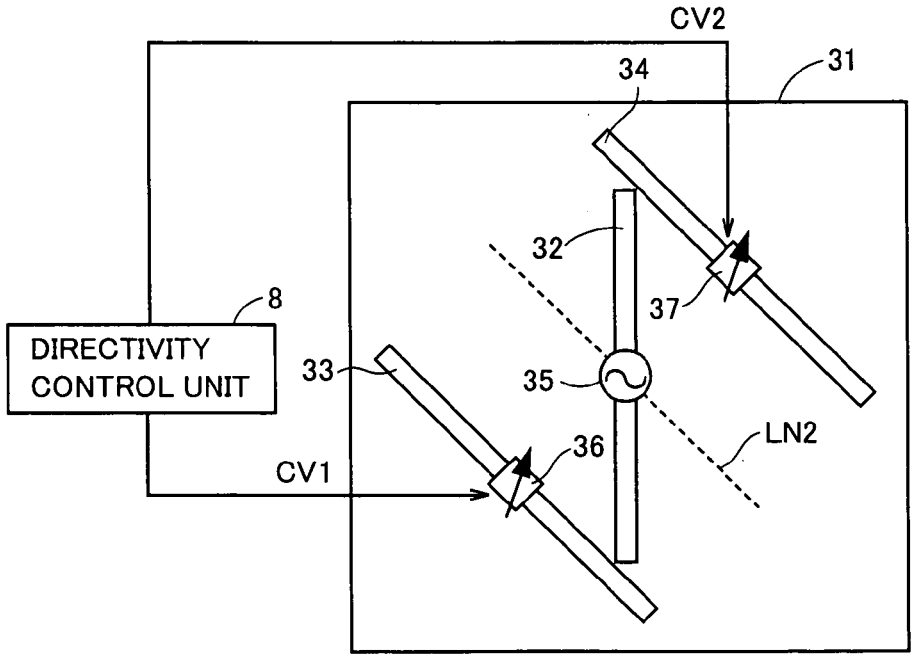
FIG. 4 is a fourth plan view of an array antenna apparatus in the embodiment of the present invention.

FIG. 4 is a fourth plan view of an array antenna apparatus in the embodiment of the present invention. An array antenna apparatus 10C includes a dielectric substrate 31, a feeder element 32, parasitic elements 33, 34, and directivity control unit 8.

Dielectric substrate 31 has a substantially rectangular two-dimensional shape. All of feeder element 32 and parasitic elements 33, 34 have an equal length. Feeder element 32 and parasitic elements 33, 34 are arranged so as to substantially form a Z shape. Here, feeder element 32 is arranged in a position corresponding to a diagonal portion of the Z shape, while two parasitic elements 33, 34 are arranged in positions corresponding to two horizontal portions of the Z shape. Feeder element 32 and parasitic elements 33, 34 do not intersect with one another. Therefore, feeder element 32 and parasitic elements 33, 34 are formed on one main surface (a surface, for example) of dielectric substrate 31.

Parasitic elements 33, 34 are arranged symmetrically around a line LN2 running through a feeder unit 35 of feeder element 32. In other words, parasitic elements 33, 34 are arranged symmetrically around feeder element 32. Here, an interval between feeder element 32 and parasitic elements 33, 34 is set to be not larger than λ/2.

Parasitic elements 33, 34 have varactor diodes 36, 37 serving as variable capacitance elements loaded, respectively. Directivity control unit 8 supplies control voltages CV1, CV2 to varactor diodes 36, 37 respectively, so as to change a combination of reactance values −Xa, −Xb (capacitance) of parasitic elements 33, 34 and to control directivity of array antenna apparatus 10C. Here, as feeder element 32 and parasitic elements 33, 34 are not parallel to one another, a polarization direction of a radio wave emitted from array antenna apparatus 10C can be controlled by changing a combination of reactance values −Xa, −Xb and changing a parasitic element to be excited.

Figure 5:
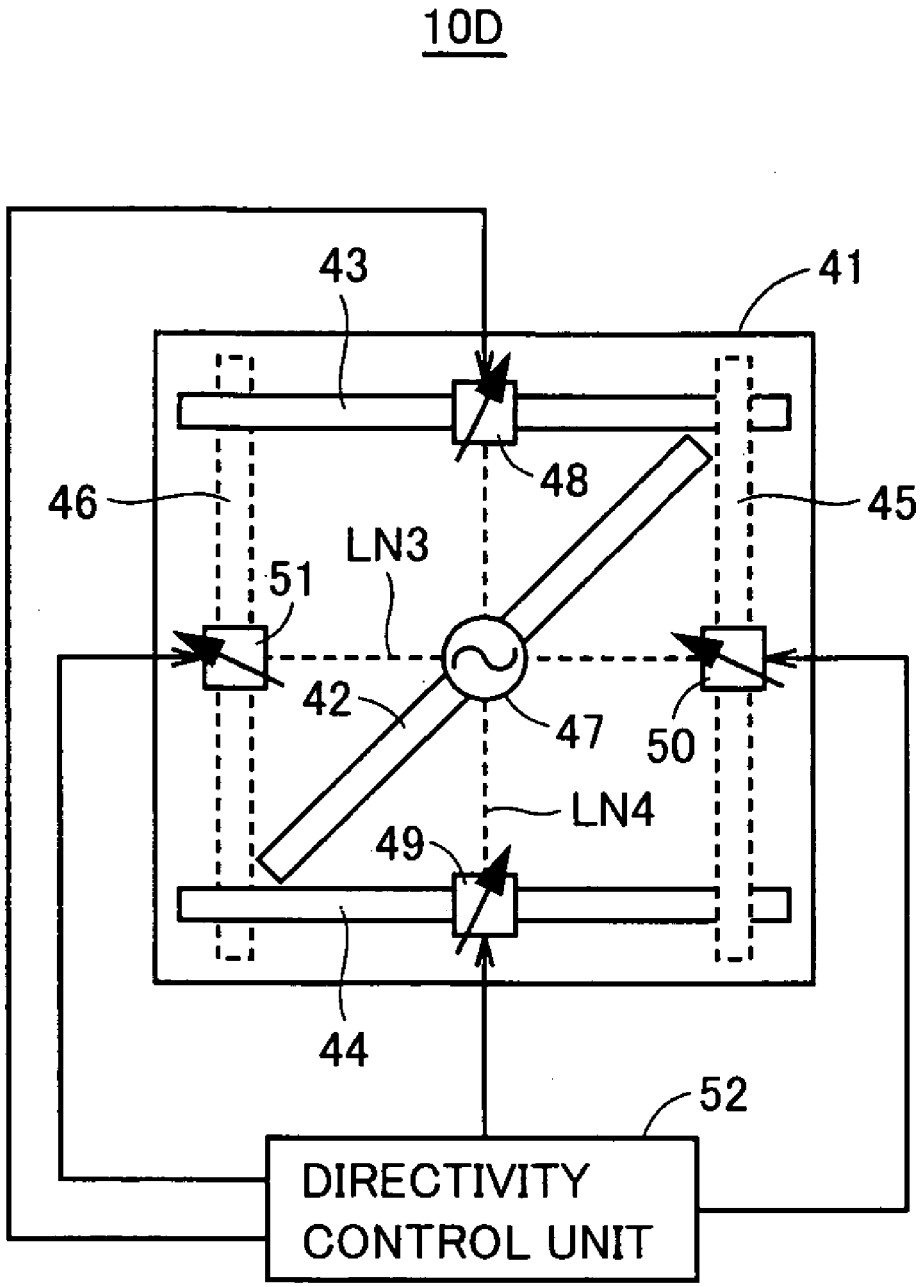
FIG. 5 is a fifth plan view of an array antenna apparatus in the embodiment of the present invention.

FIG. 5 is a fifth plan view of an array antenna apparatus in the embodiment of the present invention. An array antenna apparatus 10D includes a dielectric substrate 41, a feeder element 42, parasitic elements 43 to 46, and a directivity control unit 52.

Dielectric substrate 41 has a substantially rectangular two-dimensional shape. All of feeder element 42 and parasitic elements 43 to 46 have an equal length. Parasitic elements 43 to 46 are arranged so as to substantially form a square, while feeder element 42 is arranged along a diagonal of the square formed by parasitic elements 43 to 46. Here, feeder element 42 and parasitic elements 43, 44 do not intersect with one another, while parasitic elements 43, 44 intersect with parasitic elements 45, 46. Therefore, feeder element 42 and parasitic elements 43, 44 are formed on one main surface (a surface, for example) of dielectric substrate 41, while parasitic elements 45, 46 are arranged on a side opposite to one main surface (surface) of dielectric substrate 41 (back surface).

Parasitic elements 43, 44 are arranged symmetrically around a line LN3 running through a feeder unit 47 of feeder element 42, and parasitic elements 45, 46 are arranged symmetrically around a line LN4 running through feeder unit 47. In other words, parasitic elements 43 to 46 are arranged symmetrically around feeder element 42. Here, an interval between feeder element 42 and parasitic elements 43 to 46 is set to be not larger than λ/2.

Parasitic elements 43 to 46 have varactor diodes 48 to 51 serving as variable capacitance elements loaded, respectively. Directivity control unit 52 changes a combination of reactance values (capacitance) of parasitic elements 43 to 46 with any one of the following two methods, so as to control directivity of array antenna apparatus 10D. Here, reactance values of parasitic elements 43 to 46 are set to −X1 to −X4, respectively.

(MTHD1) One reactance value of reactance values −X1 to −X4 (any one of −X1 to −X4) is varied, or alternatively, three reactance values of reactance values −X1 to −X4 are varied simultaneously.

(MTHD2) Reactance values −X1 to −X4 are divided into two sets of two reactance values (a set of [−X1, −X3] and a set of [−X2, −X4], for example), and the two sets are switched.

Directivity control unit 52 changes a combination of reactance values (capacitance) of parasitic elements 43 to 46 with any one method out of MTHD1, 2 described above, so as to control directivity of array antenna apparatus 10D. Here, as feeder element 42 and parasitic elements 43, 44 are not parallel to one another, a polarization direction of a radio wave emitted from array antenna apparatus 10D can be controlled by changing a combination of reactance values −Xa, −Xb and changing a parasitic element to be excited.

Figure 6:
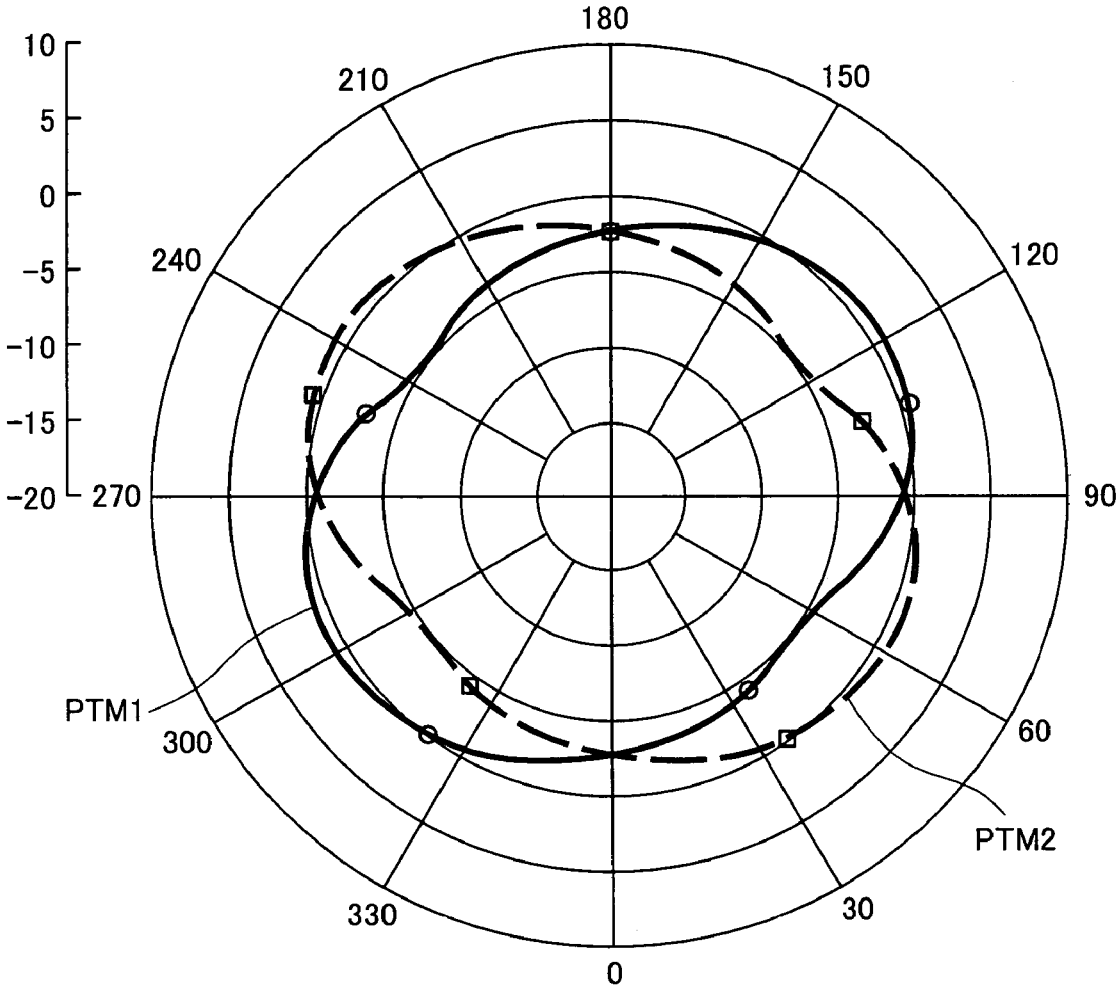
FIG. 6 illustrates a directivity gain pattern of the array antenna apparatus shown in FIG. 1.

FIG. 6 illustrates a directivity gain pattern of array antenna apparatus 10 shown in FIG. 1. In FIG. 6, a longitudinal direction of feeder element 2 represents a direction of 0°. When the reactance values loaded to parasitic elements 2, 3 are set to −Xa1, −Xb1 respectively, a set of reactance values [−Xa1, −Xb1] is switched between [−Xa1=−455Ω, −Xb1=−37Ω] and [−Xa1=−37Ω, −Xb1=−455Ω]. In FIG. 6, a pattern PTM1 represents a directivity gain pattern when a set of reactance values [−Xa1, −Xb1] is set to [−Xa=−455Ω, −Xb=−37Ω], while a pattern PTM2 represents a directivity gain pattern when a set of reactance values [−Xa1, −Xb1] is set to [−Xa=−37Ω, −Xb=−455Ω].

When a set of reactance values [−Xa1, −Xb1] is set to [−Xa=−455Ω, −Xb1=−37Ω] (pattern PTM1), deep null is no longer present, and gain is highest in directions of 120° and 300° and lowest in directions of 60° and 240°.

When a set of reactance values [−Xa1, −Xb1] is set to [−Xa1=−37Ω, −Xb1=−455Ω] (pattern PTM2), deep null is again no longer present, and gain is highest in directions of 60° and 240° and lowest in directions of 120° and 300°.

Therefore, array antenna apparatus 10 has directivity in all azimuths, and by switching directivity, the direction attaining low gain is switched from directions of 60° and 240° to directions of 120° and 300°.

As a result, in array antenna apparatus 10, directivity thereof can be switched while impedance matching is being maintained, and a direction attaining zero gain can be eliminated. In addition, by switching the directivity while maintaining impedance matching, the direction attaining low gain can be switched.

Figure 7:
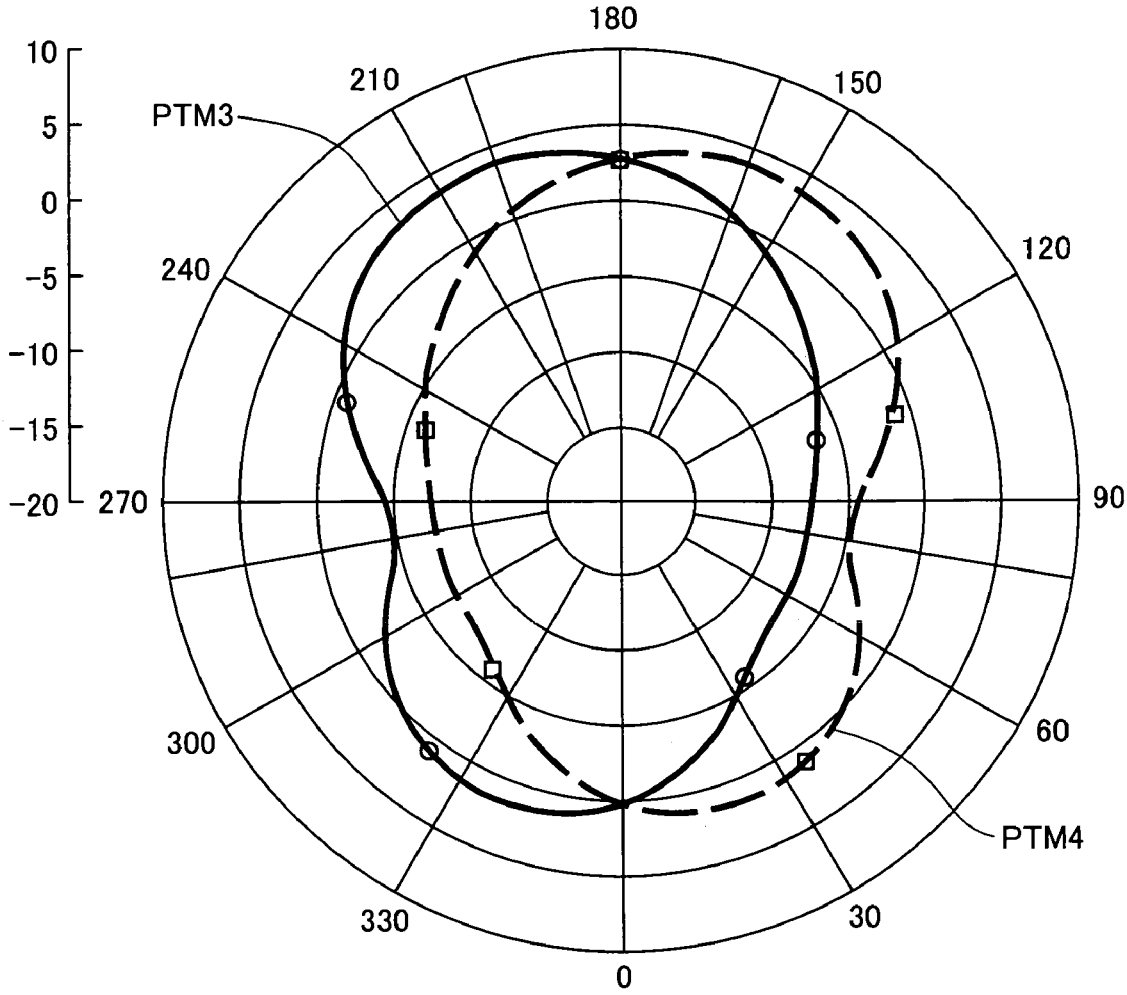
FIG. 7 illustrates a directivity gain pattern of the array antenna apparatus shown in FIG. 2.

FIG. 7 illustrates a directivity gain pattern of array antenna apparatus 10A shown in FIG. 2. In FIG. 7, a direction orthogonal to feeder element 12 represents a direction of 0°. When the reactance values loaded to parasitic elements 13, 14 are set to −Xa2, −Xb2 respectively, a set of reactance values [−Xa2, −Xb2] is switched between [−Xa2=−455Ω, −Xb2=−37Ω] and [−Xa2=−37Ω, −Xb2=−455Ω]. In FIG. 7, a pattern PTM3 represents a directivity gain pattern when a set of reactance values [−Xa2, −Xb2] is set to [−Xa2=−455Ω, −Xb2=−37Ω], while a pattern PTM4 represents a directivity gain pattern when a set of reactance values [−Xa2, −Xb2] is set to [−Xa2=−37Ω, −Xb2=−455Ω].

When a set of reactance values [−Xa2, −Xb2] is set to [−Xa2=−455Ω, −Xb2=−37Ω] (pattern PTM3), deep null is no longer present, and gain is highest in a direction of approximately 200° and lowest in a direction of approximately 280°.

When a set of reactance values [−Xa2, −Xb2] is set to [−Xa2=−37Ω, −Xb2=−455Ω] (pattern PTM4), deep null is no longer present, and gain is highest in a direction of approximately 160° and lowest in a direction of approximately 80°.

Therefore, array antenna apparatus 10A does not have a direction attaining zero gain, and by switching the directivity, the direction attaining low gain is switched from a direction of approximately 280° to a direction of approximately 80°.

As a result, in array antenna apparatus 10A, directivity thereof can be switched while impedance matching is being maintained, and a direction attaining zero gain can be eliminated. In addition, by switching the directivity while maintaining impedance matching, the direction attaining low gain can be switched.

Figure 8:
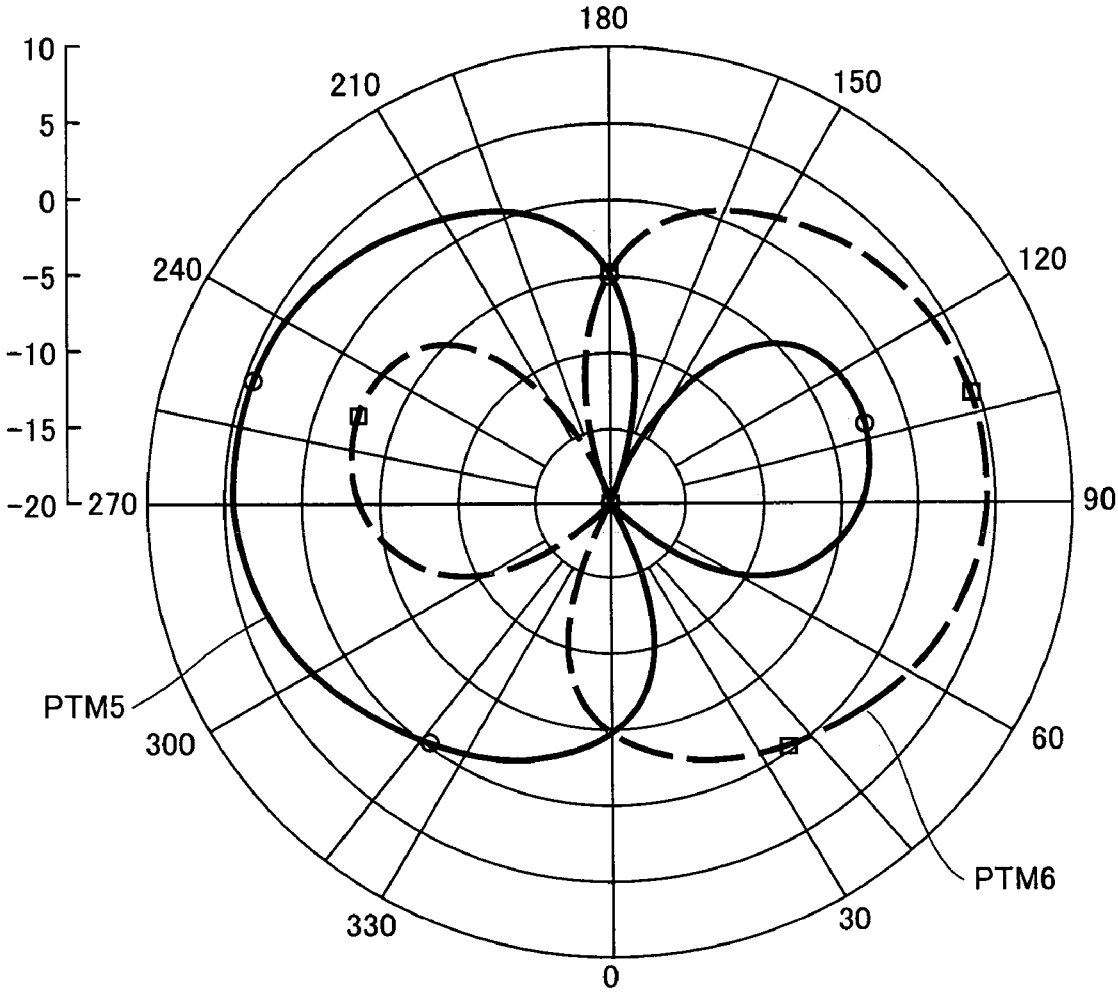
FIG. 8 illustrates a directivity gain pattern of the array antenna apparatus shown in FIG. 3.

FIG. 8 illustrates a directivity gain pattern of the array antenna apparatus 10B shown in FIG. 3. In FIG. 8, a longitudinal direction of feeder element 22 represents a direction of 0°. When the reactance values loaded to parasitic elements 23, 24 are set to −Xa3, −Xb3 respectively, a set of reactance values [−Xa3, −Xb3] is switched between [−Xa3=−455Ω, −Xb3=−37Ω] and [−Xa3=−37Ω, −Xb3=−455Ω]. In FIG. 8, a pattern PTM5 represents a directivity gain pattern when a set of reactance values [−Xa3, −Xb3] is set to [−Xa3=−455Ω, −Xb3=−37Ω], while a pattern PTM6 represents a directivity gain pattern when a set of reactance values [−Xa3, −Xb3] is set to [−Xa3=−37Ω, −Xb3=−455Ω].

When a set of reactance values [−Xa3, −Xb3] is set to [−Xa3=−455Ω, −Xb3=−37Ω] (pattern PTM5), deep null is present in directions of approximately 40° and 160°, however, deep null is not present in other directions. Gain is highest in a direction of approximately 260°.

When a set of reactance values [−Xa3, −Xb3] is set to [−Xa3=−37Ω, −Xb3=−455Ω] (pattern PTM6), deep null is present in directions of approximately 200° and 320°, however, deep null is not present in other directions. Gain is highest in a direction of approximately 100°.

By switching directivity, a direction in which null is present is switched between directions of approximately 40° and 160° and directions of approximately 200° and 320°. Therefore, array antenna apparatus 10B has gain in all directions.

Accordingly, array antenna apparatus 10B has no direction attaining zero gain, and by switching the directivity, a null direction is switched from directions of approximately 40° and 160° to directions of approximately 200° and 320°.

As a result, in array antenna apparatus 10B, directivity thereof can be switched while impedance matching is being maintained, and a direction attaining zero gain can be eliminated. In addition, by switching the directivity while maintaining impedance matching, the direction attaining low gain can be switched.

Figure 9:
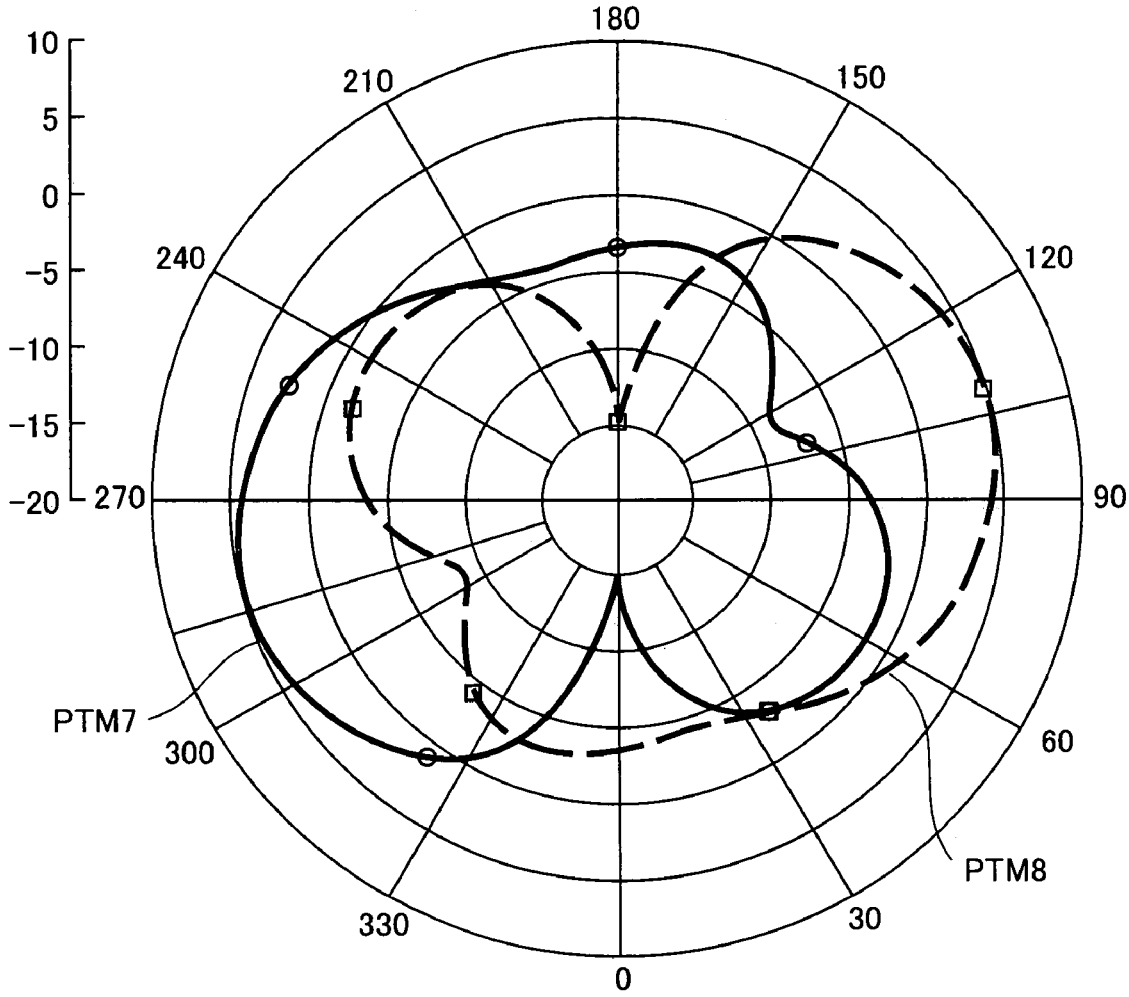
FIG. 9 illustrates a directivity gain pattern of the array antenna apparatus shown in FIG. 4.

FIG. 9 illustrates a directivity gain pattern of the array antenna apparatus 10C shown in FIG. 4. In FIG. 9, a longitudinal direction of feeder element 32 represents a direction of 0°. When the reactance values loaded to parasitic elements 33, 34 are set to −Xa4, −Xb4 respectively, a set of reactance values [−Xa4, −Xb4] is switched between [−Xa4=−455Ω, −Xb4=−37Ω] and [−Xa4=−37Ω, −Xb4=−455Ω]. In FIG. 9, a pattern PTM7 represents a directivity gain pattern when a set of reactance values [−Xa4, −Xb4] is set to [−Xa4=−455Ω, −Xb4=−37Ω], while a pattern PTM8 represents a directivity gain pattern when a set of reactance values [−Xa4, −Xb4] is set to [−Xa4=−37Ω, −Xb4=−455Ω].

When a set of reactance values [−Xa4, −Xb4] is set to [−Xa4=−455Ω, −Xb4=−37Ω] (pattern PTM7), deep null is no longer present, and gain is highest in a direction of approximately 280° and lowest in a direction of approximately 360° (0°).

When a set of reactance values [−Xa4, −Xb4] is set to [−Xa4=−37Ω, −Xb4=−455Ω] (pattern PTM8), deep null is no longer present, and gain is highest in a direction of approximately 100° and lowest in a direction of approximately 180°.

Accordingly, array antenna apparatus 10C has no direction attaining zero gain, and by switching the directivity, a direction attaining low gain is switched from a direction of approximately 360° (0°) to a direction of approximately 180°.

As a result, in array antenna apparatus 10C, directivity thereof can be switched while impedance matching is being maintained, and a direction attaining zero gain can be eliminated. In addition, by switching the directivity while maintaining impedance matching, the direction attaining low gain can be switched.

Figure 10A:
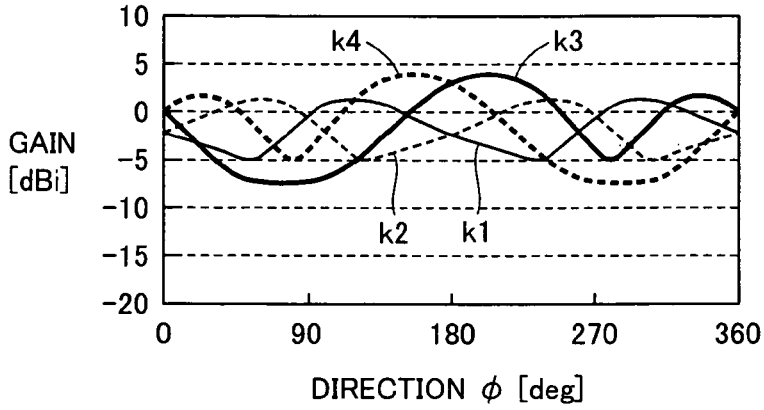
FIGS. 10A to 10C show a relation between a direction and antenna gain.
Figure 10B:
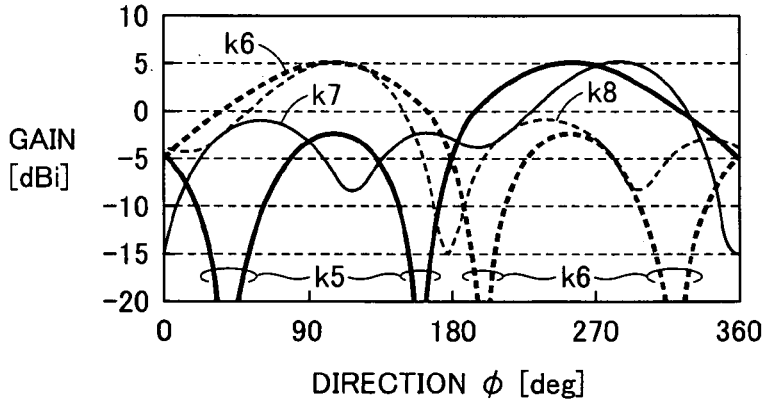
Figure 10C:
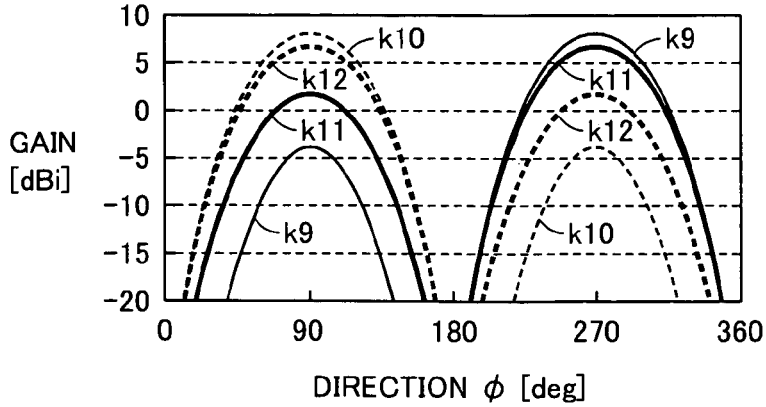

FIGS. 10A to 10C show a relation between a direction and antenna gain. In FIG. 10A, curves k1, k2 represent a relation between a direction and gain in array antenna apparatus 10 shown in FIG. 1, while curves k3, k4 represent a relation between a direction and gain in array antenna apparatus 10A shown in FIG. 2. Curves k1, k3 show an example in which sets of reactance values [−Xa1, −Xb1], [−Xa2, −Xb2]=[−455Ω, −37Ω], while curves k2, k4 show an example in which sets of reactance values [−Xa1, −Xb1], [−Xa2, −Xb2]=[−37Ω, −455Ω].

In FIG. 10B, curves k5, k6 represent a relation between a direction and gain in array antenna apparatus 10B shown in FIG. 3, while curves k7, k8 represent a relation between a direction and gain in array antenna apparatus 10C shown in FIG. 4. Curves k5, k7 show an example in which sets of reactance values [−Xa3, −Xb3], [−Xa4, −Xb4]=[−455Ω, −37Ω], while curves k6, k8 show an example in which sets of reactance values [−Xa3, −Xb3], [−Xa4, −Xb4]=[−37Ω, −455Ω].

Figure 11:
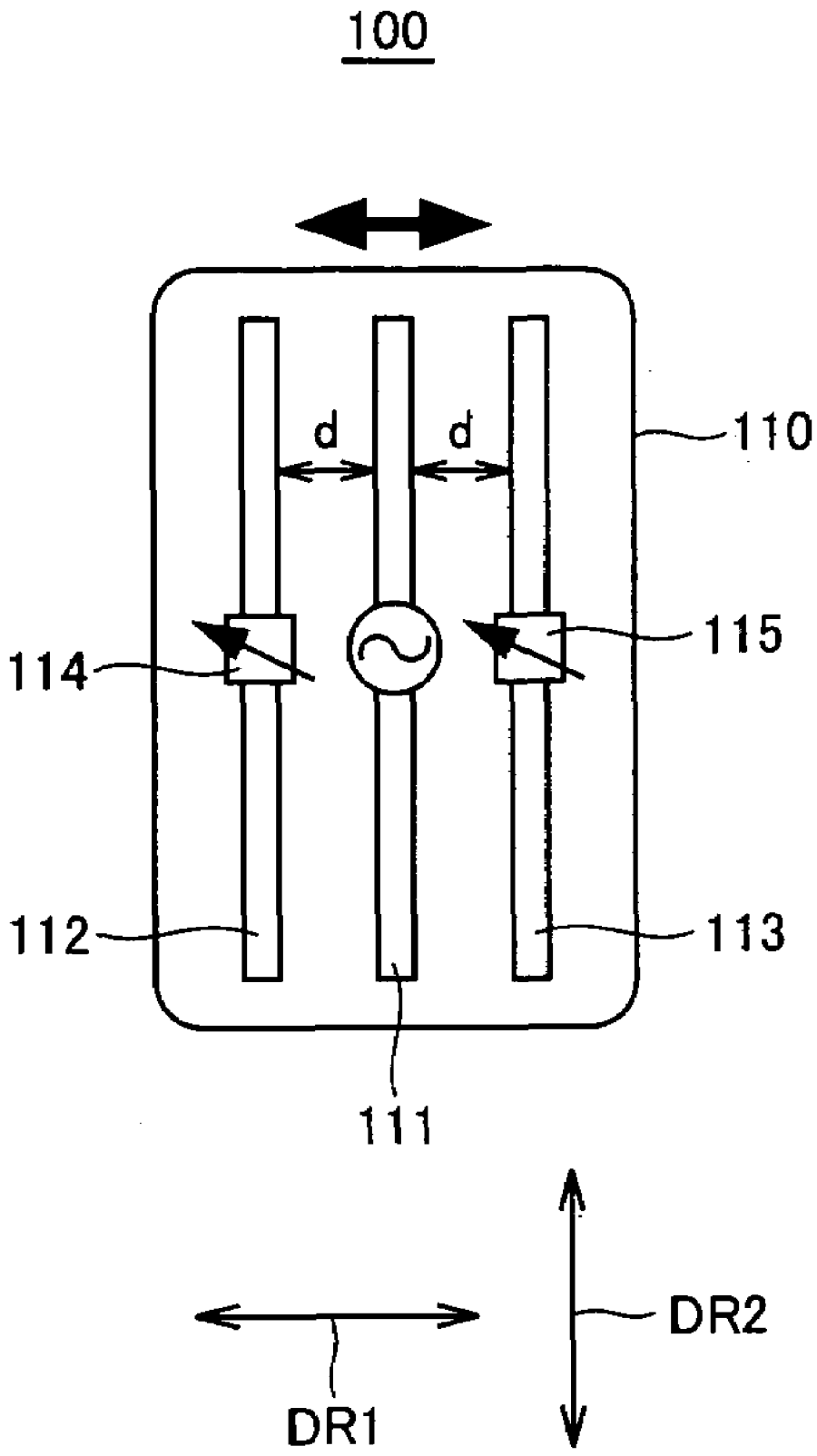
FIG. 11 is a plan view of a conventional array antenna apparatus.
Figure 12:
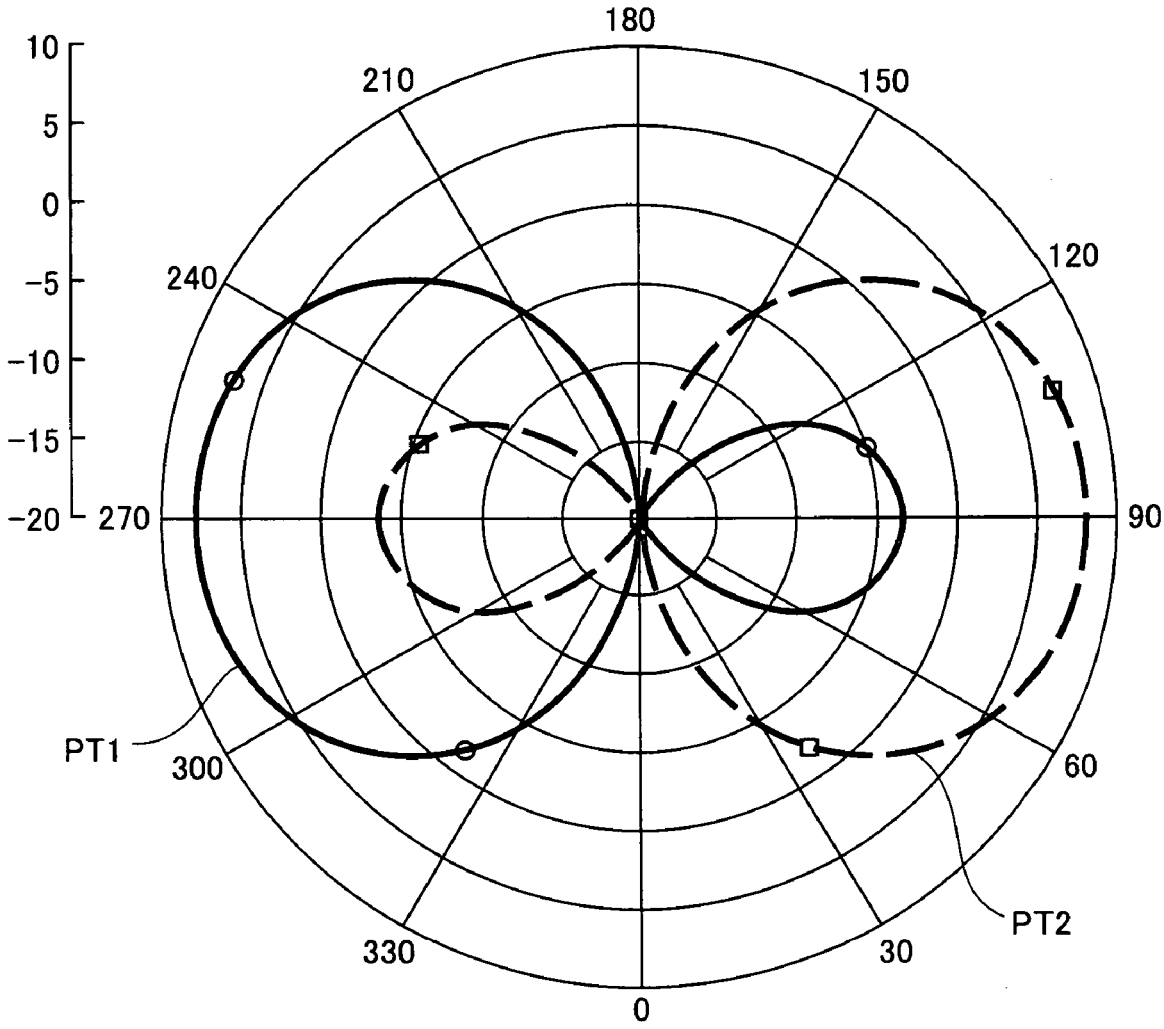
FIG. 12 illustrates a directivity gain pattern in a $\phi$ plane when interval d is set to $\lambda/4$.
Figure 13:
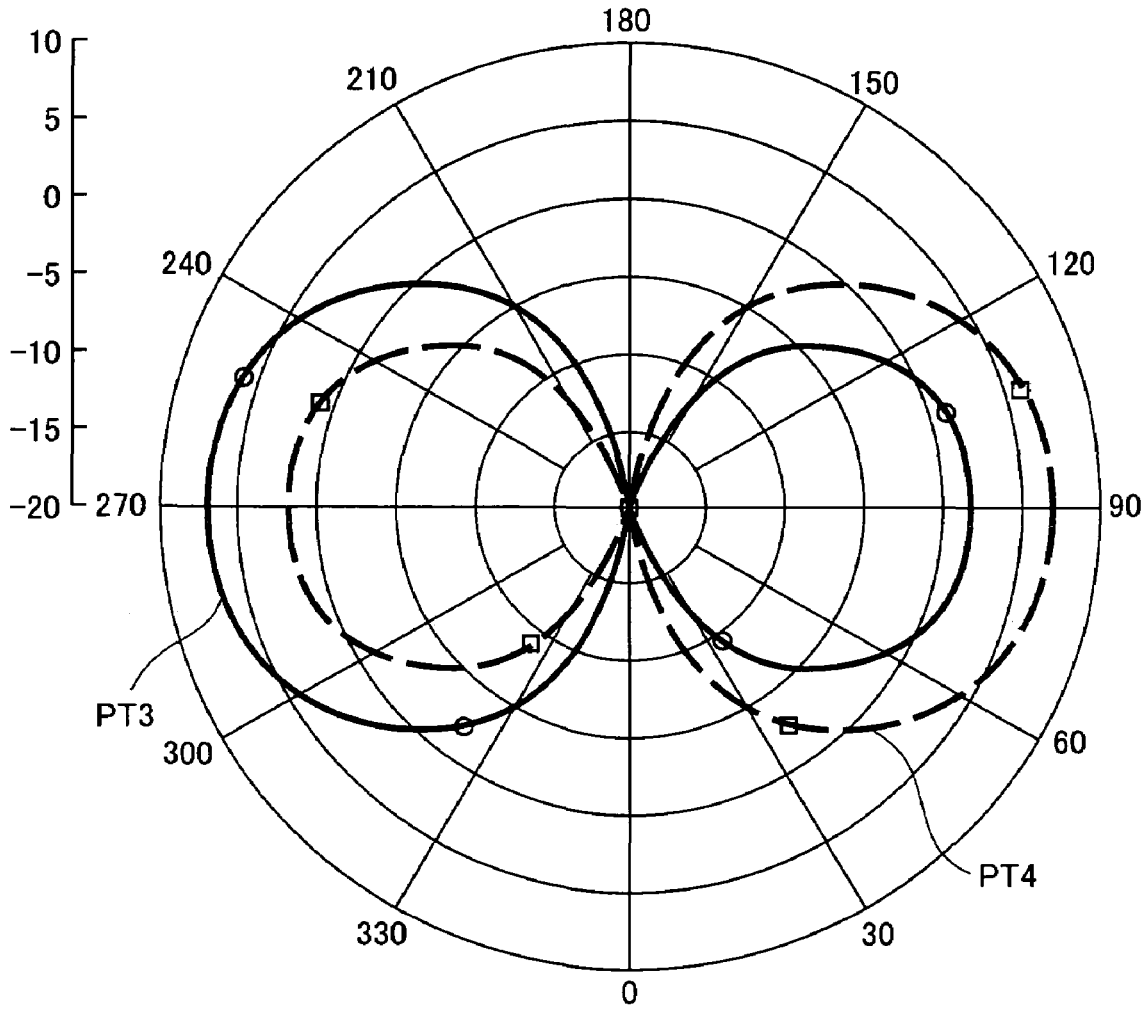
FIG. 13 illustrates a directivity gain pattern in the $\phi$ plane when interval d is set to $\lambda/10$.

In FIG. 10C, curves k9, k10 represent a relation between a direction and gain in array antenna apparatus 100 having an element interval d set to λ/4 shown in FIG. 11, while curves k11, k12 represent a relation between a direction and gain in array antenna apparatus 100 having an element interval d set to λ/10 shown in FIG. 12. Curves k9, k11 show an example in which a set of reactance values is set to [−455Ω, −37Ω], while curves k10, k12 show an example in which a set of reactance values is set to [−37Ω, −455Ω].

In conventional array antenna apparatus 100, as shown with curves k9 to k12, gain is zero in directions of 0° and 180° regardless of element interval d. Even when a set of reactance values is switched, the direction attaining zero gain is not changed.

In contrast, according to array antenna apparatuses 10, 10A, 10B, and 10C shown in FIGS. 1 to 4, as shown with curves k1 to k8, a direction attaining lowest gain or a null direction is switched by switching a set of reactance values, whereby gain is attained in all directions. In addition, one feeder element and two parasitic elements are arranged in a shape of the arrow or in the Z shape as shown in FIGS. 3 and 4, so that a difference between a maximum gain value and a minimum gain value becomes greater, thereby directivity of a transmitted/received radio wave being enhanced.

As described above, according to array antenna apparatuses 10, 10A, 10B, and 10C shown in FIGS. 1 to 4, a direction attaining zero gain can be eliminated, and directivity can be switched while impedance matching is being maintained.

In the description above, an array antenna apparatus in which a feeder element intersects with a parasitic element and an array antenna apparatus in which a feeder element does not intersect with a parasitic element have been discussed. In the array antenna apparatus according to the present invention, an extension line from a parasitic element or the parasitic element itself should only intersect with an extension line from a feeder element or the feeder element itself.

In addition, in the description above, the feeder element and the parasitic element have been formed on the surface of the dielectric substrate, that is, formed two-dimensionally. The present invention, however, is not limited to such an example, and the feeder element and the parasitic element may be formed three-dimensionally in a manner described above.

Moreover, the feeder element and the parasitic element may not necessarily have an equal length and width (thickness).

Furthermore, the feeder element and the parasitic element should only intersect at some portion, without limited to the central portion of each element.

In addition, the array antenna apparatus according to the present invention should only be such that: it includes a feeder element and at least one parasitic element; an interval between each of at least one parasitic elements and the feeder element is set to be not larger than half wavelength of a transmitted/received radio wave; when the parasitic element and the feeder element are projected on one plane, the parasitic element is arranged such that a longitudinal direction thereof is at a prescribed angle with respect to a longitudinal direction of the feeder element; and the directivity of the array antenna apparatus is controlled by varying at least one capacitance of at least one variable capacitance element loaded to at least one parasitic element.

Moreover, parasitic elements 3, 4, 13, 14, 23, 24, 33, 34, and 43 to 46 described above may have an arc shape or a bent shape.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An array antenna apparatus comprising:

a feeder element;

at least one parasitic element having a variable capacitance element loaded, and a directivity control unit varying at least one capacitance of the variable capacitance element loaded to said at least one parasitic element, so as to control directivity; wherein an interval between each of said at least one parasitic elements and said feeder element is set to be at most half wavelength of a radio wave that is transmitted and received, and when said at least one parasitic element and said feeder element are projected on one plane, said at least one parasitic element is arranged such that a longitudinal direction of said at least one parasitic element is at a prescribed angle with respect to a longitudinal direction of said feeder element.

2. The array antenna apparatus according to claim 1, wherein said feeder element and said at least one parasitic element intersect with each other at one portion of each element.

3. The array antenna apparatus according to claim 2, wherein said at least one parasitic element includes first to fourth parasitic elements arranged so as to substantially form a rectangle, and said feeder element is arranged along a diagonal of said rectangle.

4. The array antenna apparatus according to claim 1, wherein said at least one parasitic element includes two or more parasitic elements, and one of said parasitic elements has one end intersecting with one end of another parasitic element.

5. The array antenna apparatus according to claim 4, wherein said two or more parasitic elements are arranged symmetrically around said feeder element.

6. The array antenna apparatus according to claim 1, wherein said feeder element and said at least one parasitic element are arranged two-dimensionally.

* * * * *